US009244412B2

(12) United States Patent
Narushima et al.

(10) Patent No.: US 9,244,412 B2
(45) Date of Patent: Jan. 26, 2016

(54) IMAGE PROCESSING APPARATUS, NON-TRANSITORY COMPUTER READABLE MEDIUM, AND IMAGE PROCESSING METHOD

(71) Applicant: FUJI XEROX CO., LTD., Minato-ku, Tokyo (JP)

(72) Inventors: Kazuhiko Narushima, Kanagawa (JP); Masafumi Ono, Kanagawa (JP); Motofumi Baba, Kanagawa (JP); Koichi Azuma, Kanagawa (JP); Kenji Kuroishi, Kanagawa (JP); Keiko Shiraishi, Kanagawa (JP); Hidenori Horie, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 239 days.

(21) Appl. No.: 13/907,127

(22) Filed: May 31, 2013

(65) Prior Publication Data

US 2014/0093266 A1 Apr. 3, 2014

(30) Foreign Application Priority Data

Oct. 2, 2012 (JP) ..... 2012-220547

(51) Int. Cl.
*G03G 15/20* (2006.01)

(52) U.S. Cl.
CPC ..... *G03G 15/2078* (2013.01); *G03G 15/205* (2013.01); *G03G 15/2039* (2013.01)

(58) Field of Classification Search
CPC ..... G03G 15/205; G03G 15/2078; G03G 15/5004; G03G 15/2039
USPC ..... 399/67, 69–70, 82
See application file for complete search history.

(56) References Cited

U.S. PATENT DOCUMENTS

| | | | | |
|---|---|---|---|---|
| 2009/0290916 | A1 | 11/2009 | Baba | |
| 2013/0164012 | A1 * | 6/2013 | Kinoshita et al. | 399/67 |
| 2014/0049789 | A1 * | 2/2014 | Baba et al. | H04N 1/00986 358/1.13 |

FOREIGN PATENT DOCUMENTS

| | | | |
|---|---|---|---|
| JP | 08-286549 A | | 11/1996 |
| JP | 2006064919 A | * | 3/2006 |
| JP | 2009-282413 A | | 12/2009 |

* cited by examiner

*Primary Examiner* — David Gray
*Assistant Examiner* — Andrew V Do
(74) *Attorney, Agent, or Firm* — Sughrue Mion, PLLC

(57) ABSTRACT

An image processing apparatus includes an image forming section that includes a fixing device, a power supply controller that controls the fixing device to a power supply state in which power is supplied or a power shut-off state, a switching section that switches a fixing mode to one of a first mode that focuses on temperature, and a second mode that focuses on productivity, and a processing controller that controls an image forming process, by selecting the first mode as initial processing when the fixing device recovers from the power shut-off state to the power supply state upon an instruction to execute a job, and selecting, as continued processing after the initial processing, the first mode or the second mode on a basis of a total processing volume of the job acquired after the instruction to execute the job is made.

3 Claims, 11 Drawing Sheets

IMAGE PROCESSING APPARATUS, NON-TRANSITORY COMPUTER READABLE MEDIUM, AND IMAGE PROCESSING METHOD

CROSS-REFERENCE TO RELATED APPLICATIONS

This application is based on and claims priority under 35 USC 119 from Japanese Patent Application No. 2012-220547 filed Oct. 2, 2012.

BACKGROUND

Technical Field

The present invention relates to an image processing apparatus, a non-transitory computer readable medium, and an image processing method.

SUMMARY

According to an aspect of the invention, there is provided an image processing apparatus including an image forming section that includes a fixing device, a power supply controller that controls the fixing device to a power supply state in which power is supplied or a power shut-off state, a switching section that switches a fixing mode to one of a first mode that focuses on temperature, and a second mode that focuses on productivity, and a processing controller that controls an image forming process, by selecting the first mode as initial processing when the fixing device recovers from the power shut-off state to the power supply state upon an instruction to execute a job, and selecting, as continued processing after the initial processing, the first mode or the second mode on a basis of a total processing volume of the job acquired after the instruction to execute the job is made.

BRIEF DESCRIPTION OF THE DRAWINGS

Exemplary embodiment of the present invention will be described in detail based on the following figures, wherein:

FIGS. 7A to 7D illustrate the fixing device according to the exemplary embodiment, of which FIG. 7A is a partial cross-sectional view illustrating a separated state of the contact and separation mechanism part, FIG. 7B is a front view illustrating a separated state of a temperature-sensitive magnetic member, FIG. 7C is a partial cross-sectional illustrating a contact state of the contact and separation mechanism part, and FIG. 7D is a front view illustrating a contact state of the temperature-sensitive magnetic member;

DETAILED DESCRIPTION

Figure 1A:
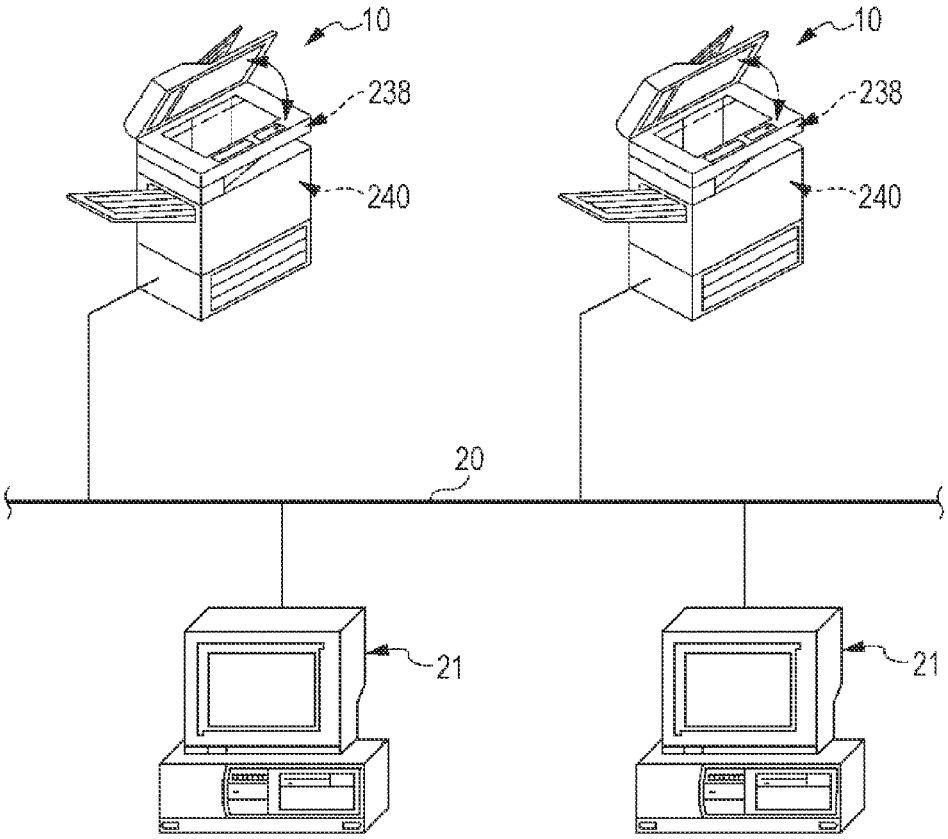
FIGS. 1A and 1B are each a connection diagram of a communications network including an image processing apparatus according to the exemplary embodiment.

As illustrated in FIG. 1A, each of image processing apparatuses 10 according to the exemplary embodiment is connected to a communications network 20 such as the Internet. While two image processing apparatuses 10 are connected in FIG. 1A, the number of image processing apparatuses 10 connected is not particularly limited but may be one, or three or more.

Multiple personal computers (PCs) 21 as pieces of information terminal equipment are connected to the communications network 20.

Figure 1B:
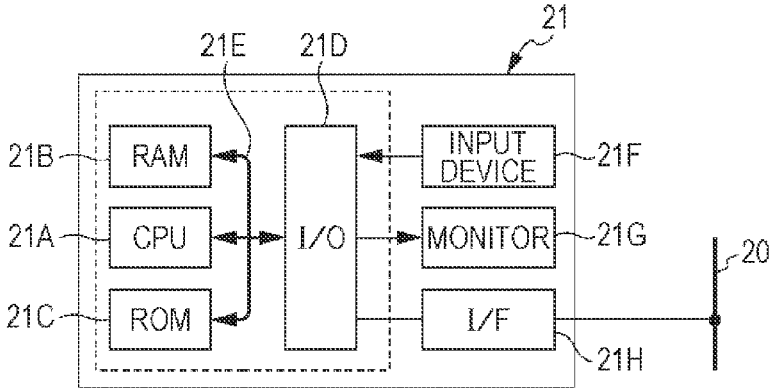

As illustrated in FIG. 1B, the PC 21 includes a CPU 21A, a RAM 21B, a ROM 21C, an I/O 21D, and a bus 21E such as a data bus or control bus that interconnects these components.

The I/O 21D is connected with an input device 21F such as a keyboard or a mouse, and a monitor 21G. The I/O 21D is connected to the communications network 20 via an I/F 21H.

While two PCs 21 are connected in FIG. 1A, the number of PCs 21 connected is not particularly limited but may be one, or three or more. The type of information terminal equipment is not limited to the PC 21. Further, the connection does not need to be by a wire. That is, the communications network used may be a communications network that transmits and receives information by radio.

As illustrated in FIG. 1A, there are a case where an instruction to perform image formation (print) is given from the PC 21 to the image processing apparatus 10 remotely by, for example, transferring data, and a case where the user stands in front of the image processing apparatus 10, and makes various operations to thereby instruct execution of processing such as copying, scan (image reading), and facsimile transmission/reception.

Figure 2:
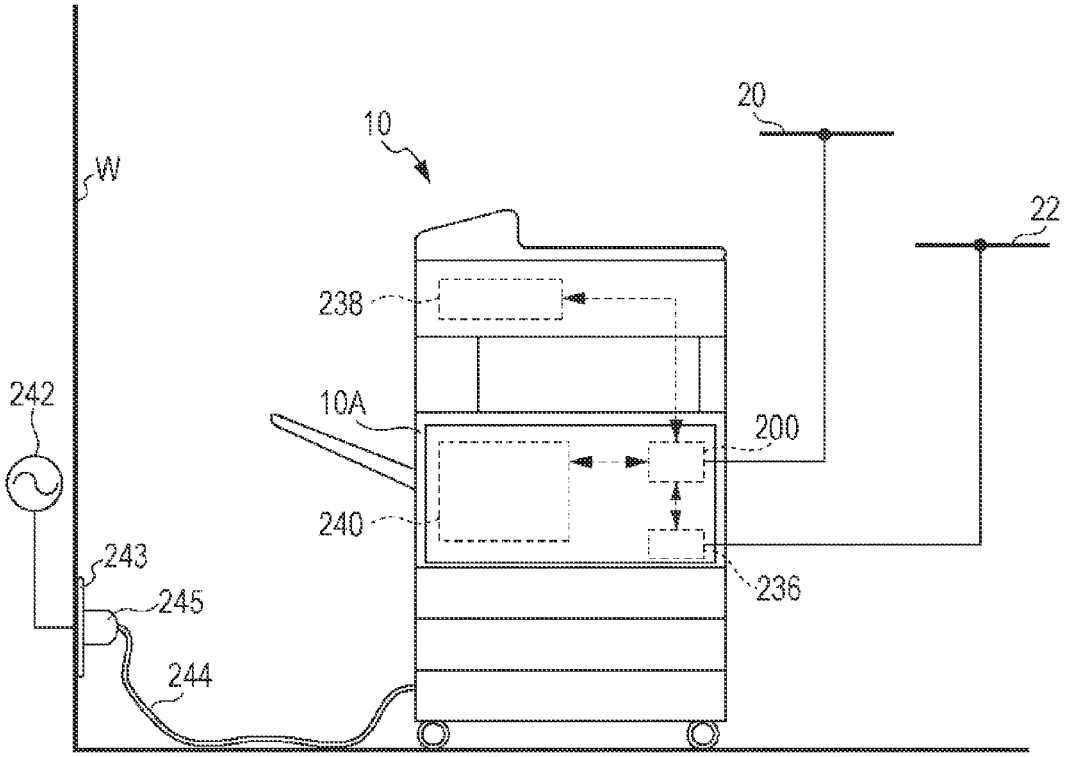
FIG. 2 schematically illustrates the image processing apparatus according to the exemplary embodiment.

FIG. 2 illustrates the image processing apparatus 10 according to the exemplary embodiment.

Roughly speaking, the image processing apparatus 10 includes an image forming section 240 that forms an image on recording paper, an image reading section 238 that reads a document image, and a facsimile communication control circuit 236. The image processing apparatus 100 includes a controller 200. The controller 200 controls the image forming section 240, the image reading section 238, and the facsimile communication control circuit 236 to temporarily store the image data of a document image read by the image reading section 238, or send out the image data that has been read to the image forming section 240 or the facsimile communication control circuit 236.

The controller 200 is connected with the communications network 20 such as the Internet. The facsimile communication control circuit 236 is connected with a telephone network 22. The controller 200 is, for example, connected to a host computer via the communications network 20, and has the function of receiving image data, or executing facsimile reception and facsimile transmission using the telephone network 22 via the facsimile communication control circuit 236.

A socket 245 is attached to the end of an input power line 244 for the image processing apparatus 10. As the socket 245 is inserted into a wiring plate 243 of a commercial power supply 242 wired to a wall surface W, the image processing apparatus 10 receives supply of power from the commercial power supply 242.

(Detailed Configuration of Image Processing Apparatus)

Figure 3:
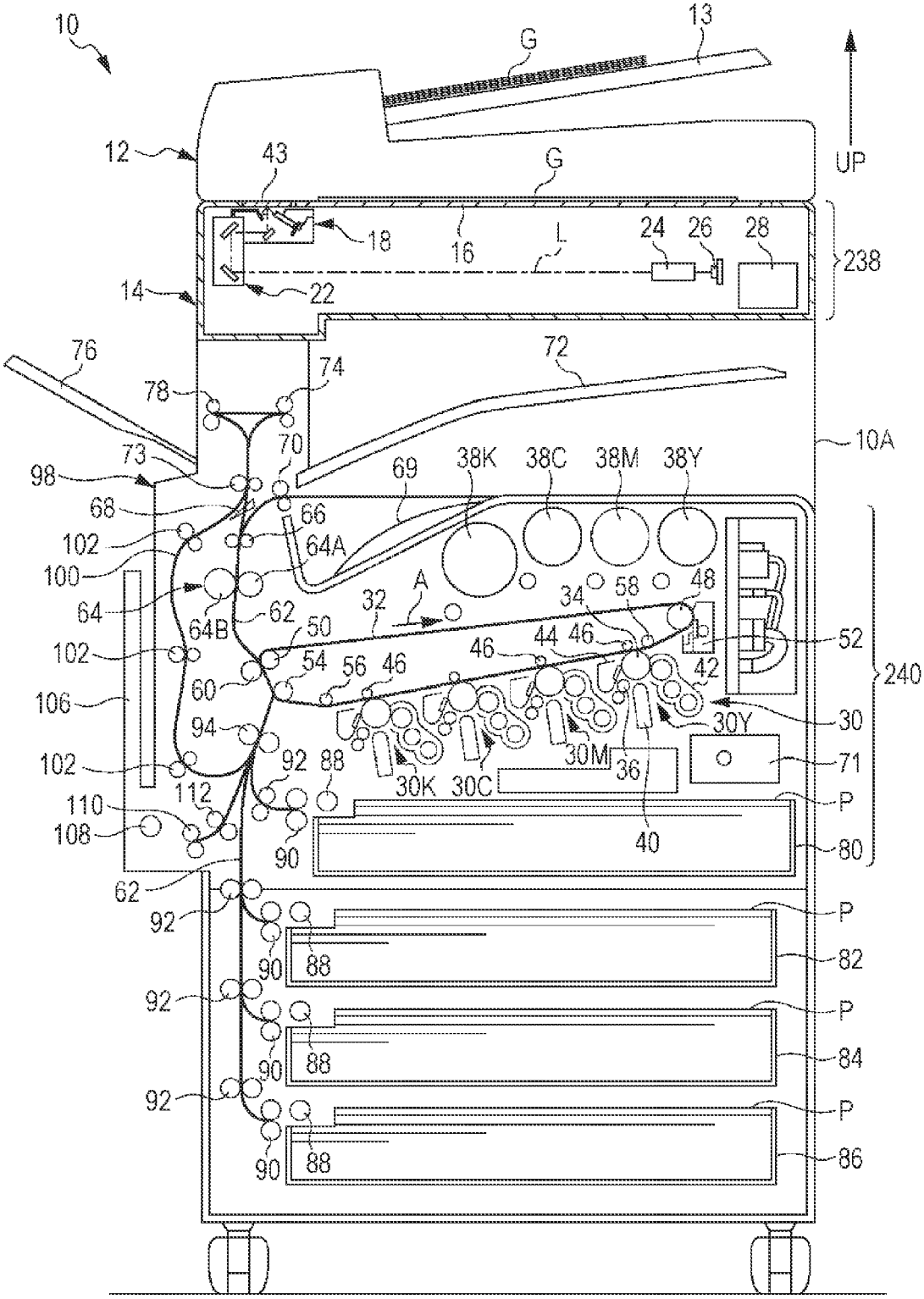
FIG. 3 illustrates the internal configuration of the image processing apparatus according to the exemplary embodiment in detail.

As illustrated in FIG. 3, an automatic document transport device 12, a first platen glass 16, and the image reading section 238 are provided in an upper part of a body 10A of the image processing apparatus 10 according to the exemplary embodiment. The automatic document transport device 12 automatically transports multiple sheets of a read document G sheet by sheet. A sheet of the read document G is placed on the first platen glass 16. The image reading section 238 reads the read document G transported by the automatic document transport device 12 or the read document G placed on the first platen glass 16. The automatic document transport device 12 includes a document table 13 on top of which multiple sheets of the read document G are placed.

The image reading section 238 includes a first mirror unit 18 and a second mirror unit 22. The first mirror unit 18 moves along the read document G placed on the first platen glass 16. The second mirror unit 22 reflects an image that is obtained by scanning with the first mirror unit 18, and guides (see an optical axis L) the image to an imaging device 26 such as a CCD line sensor via a lens 24.

The image forming section 240 is provided in the vertically central part of the body 10A. The image forming section 240 includes multiple image forming units 30. The image forming units 30 form toner images of different colors, and are placed in an inclined manner with respect to the horizontal direction. Further, an endless-type intermediate transfer belt 32 is provided over the image forming units 30. As the intermediate transfer belt 32 is driven to circulate in the direction of an arrow A in FIG. 3, toner images of various colors formed in the image forming units 30 are transferred to the intermediate transfer belt 32.

As the image forming units 30, four image forming units 30Y, 30M, 30C, and 30K for yellow (Y), magenta (M), cyan (C), and black (K), respectively, are provided in the stated order.

The image forming unit 30Y basically includes an image carrier 34, a charging member 36, an exposing device 40, and a developing unit 42. Although the other three image forming units 30M, 30C, and 30K also include the same components, these components are not designated by symbols in FIG. 3.

Toner cartridges 38Y, 38M, 38C, and 38K are provided above the intermediate transfer belt 32. The toner cartridges 38Y, 38M, 38C, and 38K each supply a predetermined color of toner to the developing unit 42 corresponding to each of the colors yellow (Y), magenta (M), cyan (C), and black (K). Since the toner cartridge 38K storing black (K) toner is used frequently, the toner cartridge 38K is larger in size than the toner cartridges for the other colors.

Also, a first transfer member 46 is provided opposite to the image carrier 34 across the intermediate transfer belt 32. The first transfer member 46 transfers a toner image formed on the surface of the image carrier 34 to the intermediate transfer belt 32. Further, a cleaning device 44 is provided so as to be in contact with the surface of the image carrier 34. The cleaning device 44 cleans residual toner or the like remaining on the surface of the image carrier 34 without being transferred from the image carrier 34 to the intermediate transfer belt 32.

Light based on image data of each color is sequentially outputted from the exposing device 40 individually provided to each of the image forming units 30Y, 30M, 30C, and 30K. As the surface of the image carrier 34 for each color uniformly charged by the charging member 36 is exposed to this light, an electrostatic latent image is formed on the surface of the image carrier 34. The electrostatic latent image formed on the surface of the image carrier 34 is developed as a toner image in each color by the developing unit 42.

The toner images in the colors yellow (Y), magenta (M), cyan (C), and black (K) sequentially formed on the surface of the image carrier 34 are transferred in a multiple transfer process by the first transfer member 46 onto the intermediate transfer belt 32 that is placed in an inclined manner above the image forming units 30Y, 30M, 30C, and 30K for the corresponding colors.

The intermediate transfer belt 32 is wound around a drive roller 48 for applying a driving force to the intermediate transfer belt 32, a support roller 50 that is driven to rotate, a tension applying roller 54 for applying tension to the intermediate transfer belt 32, a first idler roller 56, and a second idler roller 58.

A cleaning device 52 that cleans the surface of the intermediate transfer belt 32 is provided opposite to the drive roller 48 across the intermediate transfer belt 32.

A second transfer member 60 is placed opposite to the support roller 50 across the intermediate transfer belt 32. The second transfer member 60 causes the toner image transferred onto the intermediate transfer belt 32 in a first transfer process to be transferred to the recording paper P in a second transfer process.

A fixing device 64 is provided above the second transfer member 60. The fixing device 64 fixes a toner image onto the recording paper P to which the toner image has been transferred by the second transfer member 60 and which is transported along a transport path 62. The fixing device 64 includes a heat roller 64A and a pressure roller 64B. The heat roller 64A is placed on the image surface side of the recording paper P. The pressure roller 64B presses the recording paper P toward the heat roller 64A.

While the heat roller 64A and the pressure roller 64B provided in the fixing device 64 are depicted as being in a simple cylindrical shape (roller shape) in FIG. 3, the actual structure is such that a thin-film fixing belt 302 (see FIG. 5) that revolves is heated by using an IH heat technique. Details in this regard will be given later with reference to FIGS. 5 to 7D.

Further, on the downstream side of the fixing device 64 in the transport direction of the recording paper P, there are provided a transport roller 66, and then a switching gate 68. The switching gate 68 switches the transport direction of the recording paper P.

A first eject roller 70 is provided downstream of the switching gate 68 in the transport direction of the recording paper P. The first eject roller 70 ejects the recording paper P guided by the switching gate 68 switched to one direction, toward a first eject section 69.

Also, a second eject roller 74 and a third eject roller 78 are provided downstream of the switching gate 68 in the transport direction of the recording paper P. The second eject roller 74 ejects the recording paper P transported by a transport roller 73 while being guided by the switching gate 68 switched to another direction, toward a second eject section 72. The third eject roller 78 ejects the recording paper P toward a third eject section 76.

Also, paper feed sections 80, 82, 84, and 86 each storing recording paper P are provided in a lower part of the body 10A and upstream of the second transfer member 60 in the transport direction of the recording paper P. For example, sheets of recording paper P of various sizes are stored in the paper feed sections 80, 82, 84, and 86. Sheets of the same size may be stored in two or more of the paper feed sections 80, 82, 84, and 86, or sheets of the same size may be stored in different orientations that are 90° to each other.

Further, the paper feed sections 80, 82, 84, and 86 are each provided with a feed roller 88. The feed roller 88 picks the stored recording paper P out of each of the paper feed sections 80, 82, 84, and 86 and passes the recording paper P to the transport path 62. A transport roller 90 and a transport roller 92 are provided downstream of the feed roller 88 in the transport direction. The transport rollers 90 and 92 transport the recording paper P sheet by sheet.

A registration roller 94 is provided downstream of the transport roller 92 in the transport direction. The registration roller 94 temporarily stops the recording paper P, and delivers the recording paper P to a second transfer position at predetermined timing.

Also, a duplex transport unit 98 is provided to the side of the second transfer position. The duplex transport unit 98 transports the recording paper P while reversing the recording paper P in order to form an image on both sides of the recording paper P. The duplex transport unit 98 is provided with a reversing path 100. The recording paper P transported by reversing the rotation of the transport roller 73 is sent into the reversing path 100. Further, multiple transport rollers 102 are provided along the reversing path 100. The recording paper P transported by the transport rollers 102 is transported to the registration roller 94 again while being reversed upside down.

A folding-type manual paper feed section 106 is provided on the outer side of the apparatus with respect to the duplex transport unit 98. A feed roller 108, and transport rollers 110 and 112 are provided in a lower part of the duplex transport unit 98. The feed roller 108 and the transport rollers 110 and 112 transport the recording paper P fed from the folding-type manual paper feed section 106 that is set in its use position. The recording paper P transported by the transport rollers 110 and 112 is transported to the registration roller 94.

(Hardware Configuration of Control System of Image Processing Apparatus)

Figure 4:
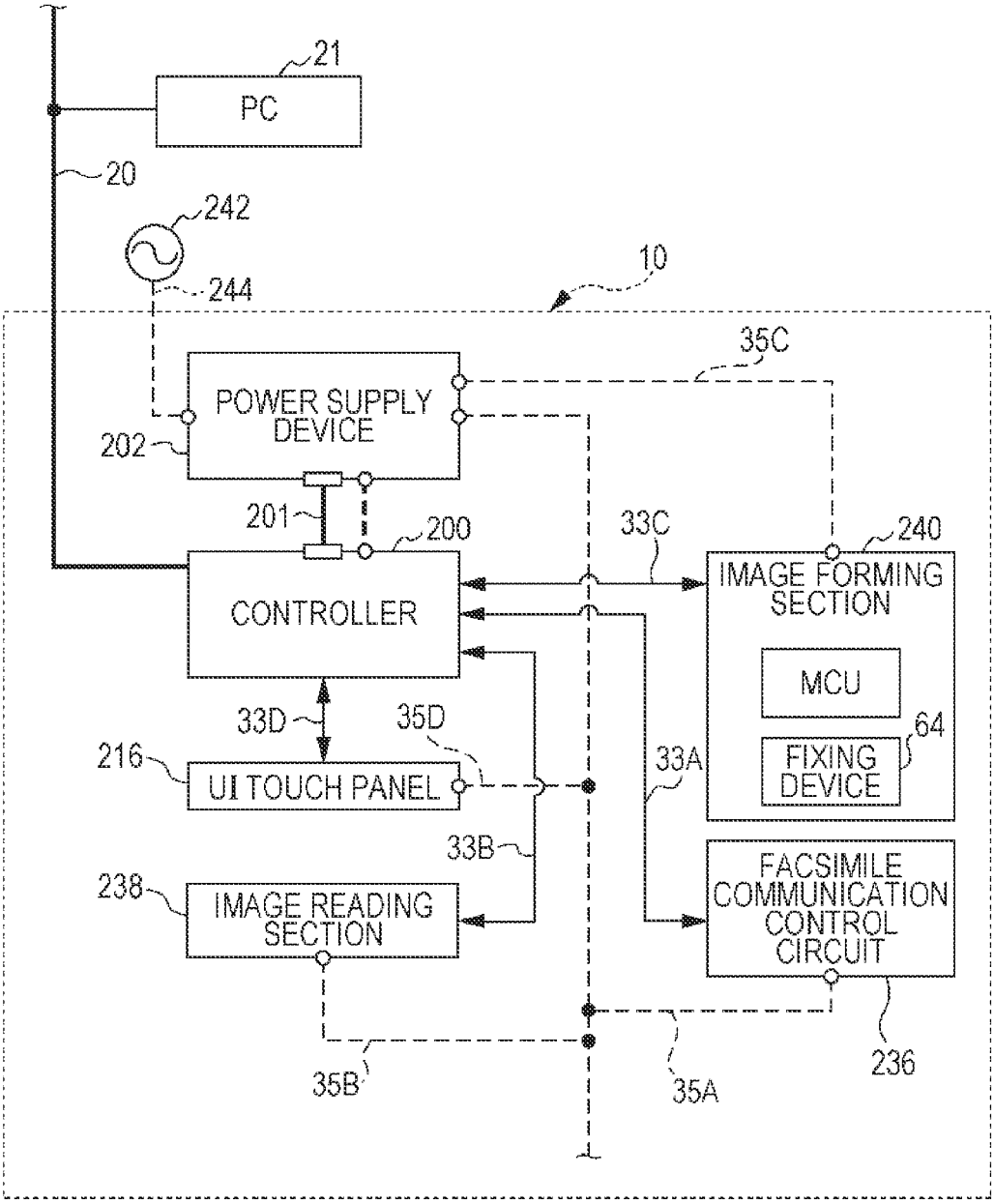
FIG. 4 is a block diagram illustrating the configuration of a control system of the image processing apparatus according to the exemplary embodiment.

FIG. 4 schematically illustrates the hardware configuration of a control system of the image processing apparatus 10.

The communications network 20 is connected to the controller 200. The facsimile communication control circuit 236, the image reading section 238, the image forming section 240, and a UI touch panel 216 are connected to the controller 200 via buses 33A to 33D such as data buses or control buses, respectively. That is, various processing sections of the image processing apparatus 100 are controlled on the basis of the controller 200. A backlight section for the UI touch panel 216 is attached to the UI touch panel 216 in some cases.

The image processing apparatus 10 includes a power supply device 202. The power supply device 202 is connected to the controller 200 by a signal harness 201.

The power supply device 202 receives supply of power from the commercial power supply 242 via the input power line 244.

The power supply device 202 is provided with power supply lines 35A to 35D. The power supply lines 35A to 35D respectively supply power to the controller 200 and the facsimile communication control circuit 236, the image reading section 238, the image forming section 240, and the UI touch panel 216 that are each provided with an independent CPU. The controller 200 is also capable of so-called partial power save control whereby the controller 200 supplies power (power supply mode) or shuts off power (sleep mode) to each processing section (device) individually. The control system including the CPU of the image forming section 240 is sometimes referred to as MCU.

The controller 200 may be provided with a human sensor to monitor the presence of a human in the vicinity of the image processing apparatus 10, and control supply of power accordingly.

Next, the fixing device (also referred to as "fuser") 64 according to the exemplary embodiment is described. In the exemplary embodiment, the heat resistant temperature and fixing temperature of the fixing device 64 are set as 240° C. and 370° C., respectively.

Figure 5:
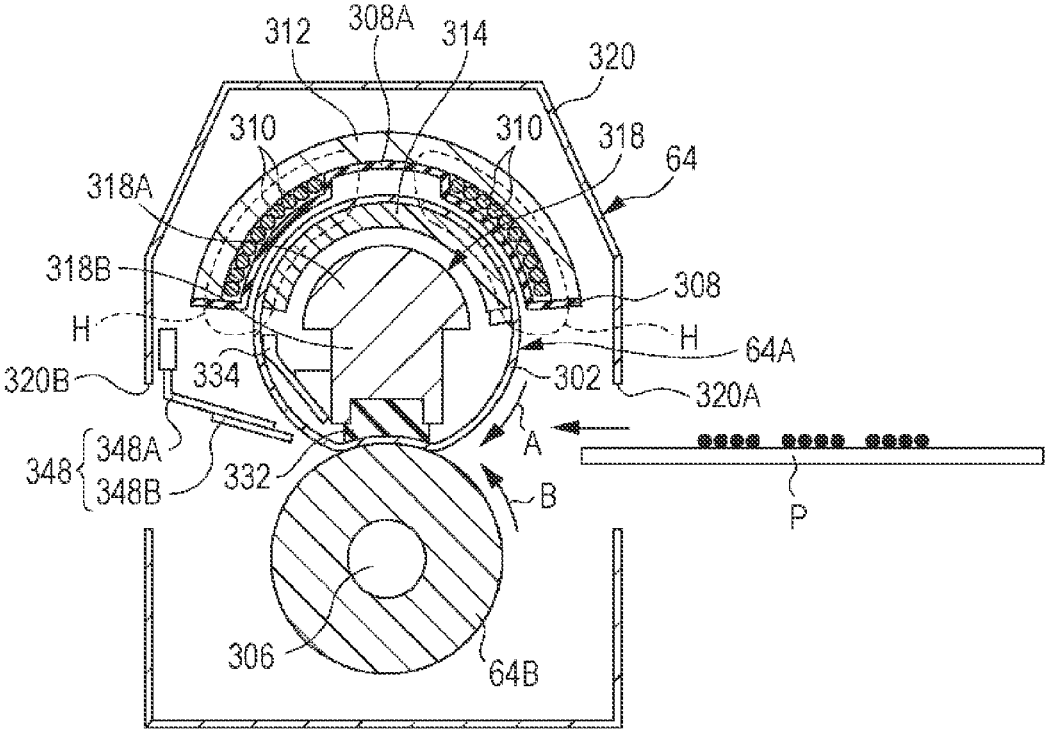
FIG. 5 is a cross-sectional view of a fixing device according to the exemplary embodiment.

As illustrated in FIG. 5, the fixing device 64 includes a housing 320 that is provided with openings 320A and 320B to allow entry and exit of the recording paper P. The fixing belt 302 in an endless form is provided inside the housing 320. The fixing belt 302 forms the outer periphery of the heat roller 64A. A cylindrical cap member (not illustrated) with a rotating shaft is fitted and secured onto either end of the fixing belt 302, thereby supporting the fixing belt 302 so as to be rotatable about the rotating shaft. A gear connected to a motor (not illustrated) that rotationally drives the fixing belt 302 is joined to one of the cap members. When the motor activates, the fixing belt 302 rotates in the direction of an arrow A in FIG. 5.

A bobbin 308 made of an insulating material is placed at a position opposite the outer peripheral surface of the fixing belt 302. The bobbin 308 is formed in a substantially arcuate shape conforming to the outer peripheral surface of the fixing belt 302. The bobbin 308 has a projection 308A that projects from substantially the central part of its surface opposite to the fixing belt 302. The separation between the bobbin 308 and the fixing belt 302 is about 1 mm to 3 mm.

An exciting coil 310 is wound around the bobbin 308 multiple times in the axial direction (depth direction with respect to the plane of FIG. 5) with the projection 308A as the center. The exciting coil 310 produces a magnetic field H when energized. A magnetic core 312 is placed at a position opposite the exciting coil 310. The magnetic core 312 is formed in a substantially arcuate shape conforming to the arcuate shape of the bobbin 308. The magnetic core 312 is supported on the bobbin 308 or the exciting coil 310.

A temperature-sensitive magnetic member 314 having the shape of a substantially arcuate plate is provided inside the fixing belt 302. The temperature-sensitive magnetic member 314 is in contact with the inner peripheral surface of the fixing belt 302. The temperature-sensitive magnetic member 314 is placed opposite the exciting coil 310, and is heated while receiving the magnetic field H together with the fixing belt 302 (IH technique). Since the temperature-sensitive magnetic member 314 has the function of accumulating heat, the temperature-sensitive magnetic member 314 is also sometimes referred to as "heat accumulating member".

A dielectric 318 made of aluminum is provided inside the temperature-sensitive magnetic member 314. The dielectric 318 may have a thickness not less than the skin depth, and may be made of a non-magnetic metal with a small specific resistance. Silver, copper, or aluminum may be used as such a material. The dielectric 318 includes an arcuate part 318A that is opposite the inner peripheral surface of the temperature-sensitive magnetic member 314, and a column part 318B formed integrally with the arcuate part 318A. Both ends of the dielectric 318 are secured to the housing 320 of the fixing device 64.

The arcuate part 318A of the dielectric 318 is placed in advance at such a position that when the magnetic flux of the magnetic field H passes through the temperature-sensitive magnetic member 314, the arcuate part 318A guides the magnetic flux of the magnetic field H. The dielectric 318 and the temperature-sensitive magnetic member 314 are separated by 1 mm to 5 mm. As described later, the dielectric 318 and the temperature-sensitive magnetic member 314 are independently supported in place.

A pressing pad 332 is secured and supported onto an end face of the column part 318B of the dielectric 318. The pressing pad 332 presses the fixing belt 302 outwards with a predetermined pressure. This makes it unnecessary to additionally provide a member for supporting each of the dielectric 318 and the pressing pad 332 in place, thus enabling miniaturization of the fixing device 64. The pressing pad 332 is made of a material having elasticity such as urethane rubber or sponge. One end face of the pressing pad 332 contacts the inner peripheral surface of the fixing belt 302 and presses the fixing belt 302.

The pressure roller 64B is held in press contact with the outer peripheral surface of the fixing belt 302. The pressure roller 64B is driven to rotate in the direction of an arrow B in FIG. 5 (direction opposite to the direction of the arrow A in FIG. 5) as the fixing belt 302 rotates.

The pressure roller 64B is formed by providing a foamed silicon rubber sponge elastic layer with a thickness of 5 mm around a core metal 306 made of aluminum or the like, and further coating the outer side of the foamed silicon rubber sponge elastic layer with a release layer made of a carbon-containing PFA with a thickness of 50 μm. The pressure roller 64B is configured to contact or separate from the outer peripheral surface of the fixing belt 302 by a retract mechanism whereby a bracket (not illustrated) that rotatably supports the pressure roller 64B swings by a cam.

A thermistor 334 is provided inside the fixing belt 302 and in an area that is not opposite the exciting coil 310 and located on the exit side of the recording paper P. The thermistor 334 measures the temperature of the inner peripheral surface of the fixing belt 302. The thermistor 334 measures the surface temperature of the fixing belt 302 by converting a resistance value that varies with the quantity of heat given from the fixing belt 302 into a temperature. The thermistor 334 contacts substantially the central part along the width direction of the fixing belt 302 so that its measured value does not vary with the size of the recording paper P.

The thermistor 334 is connected to the MCU (see FIG. 4) of the image forming section 240. The MCU measures the temperature of the surface of the fixing belt 302 by performing temperature conversion on the basis of the quantity of electricity sent from the thermistor 334. Then, the MCU compares this measured temperature with a set fixing temperature (e.g. 170° C.) stored in advance, and in a case where the measured temperature is lower than the set fixing temperature, the MCU energizes the exciting coil 310 so as to produce the magnetic field H (see FIG. 5) as a magnetic circuit. In a case where the measured temperature is higher than the set fixing temperature, the MCU stops the energization.

A peeling member 348 is provided at a position near the contact part (nip part) between the fixing belt 302 and the pressure roller 64B, on the downstream side in the transport direction of the recording paper P. The peeling member 348 includes a support part 348A that is secured in place at one end, and a peeling sheet 348B supported on the support part 348A. The peeling sheet 348B is so placed that its end is in close proximity to or in contact with the fixing belt 302.

Next, a contact and separation mechanism for the temperature-sensitive magnetic member 314 with respect to the fixing belt 302 is described.

As the fixing mode of the fixing device 64, a fixing process performed in a state in which the temperature-sensitive magnetic member 314 is in contact with the fixing belt 302 is defined as "heat accumulation mode", and a fixing process performed in a state in which the temperature-sensitive magnetic member 314 is separated from the fixing belt 302 is defined as "fast heating mode". The specifications of each of these modes will be described later.

Figure 6:
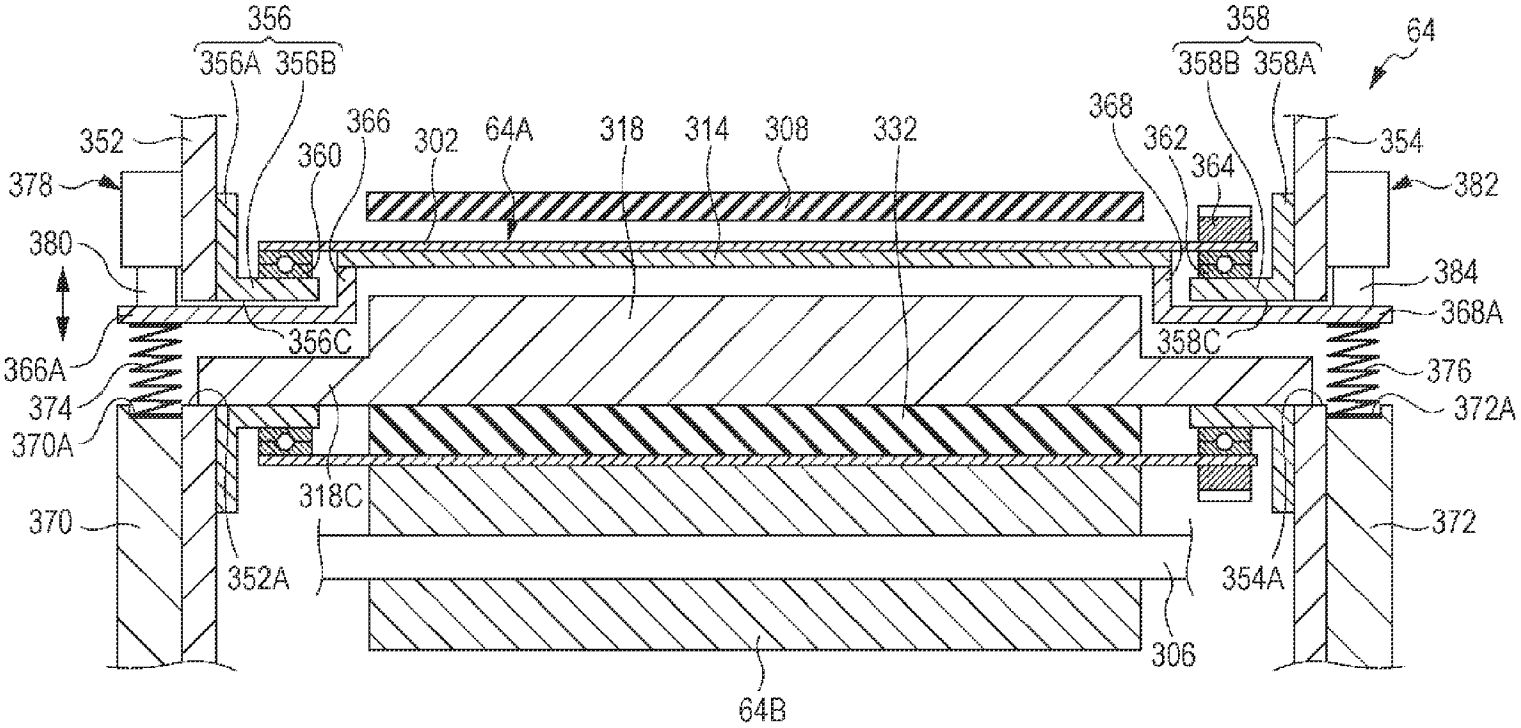
FIG. 6 is a cross-sectional view illustrating the contact and separation mechanism part of the fixing device according to the exemplary embodiment.

As illustrated in FIG. 6, inside the fixing device 64, a pair of side plates 352 and 354 are provided upright so as to sandwich the fixing belt 302 and the pressure roller 64B from both ends. The side plates 352 and 354 respectively have through-holes 352A and 354A each formed at a position opposite either end of the fixing belt 302. The through-holes 352A and 354A have a diameter smaller than the inside diameter of the fixing belt 302.

Support members 356 and 358 are provided to the inner walls of the side plates 352 and 354, respectively, with a fastening part (not illustrated) such as a screw. The support member 356 includes a flat plate part 356A, a cylindrical shaft part 356B, and a through-hole 356C. The flat plate part 356A is secured to the side plate 352. The shaft part 358B projects from the flat plate part 356A. The through-hole 356C extends through the flat plate part 356A and the shaft part 356B.

Likewise, the support member 358 includes a flat plate part 358A, a cylindrical shaft part 358B, and a through-hole 358C. The flat plate part 358A is secured to the side plate 354. The shaft part 358B projects from the flat plate part 358A. The through-hole 358C extends through the flat plate part 358A and the shaft part 358B.

The through-holes 352A and 356C are the same in diameter, and communicate with each other in a state in which their inner peripheral walls coincide with each other. Likewise, the through-holes 354A and 358C are the same in diameter, and communicate with each other in a state in which their inner peripheral walls coincide with each other.

A bearing 360 and a bearing 362 are inserted and secured onto the shaft part 356B and the shaft part 358B, respectively. The outside diameter of the bearings 360 and 362 is substantially the same as the inside diameter of the fixing belt 302. The inner peripheral surface at either end of the fixing belt 302 is joined and secured to the outer peripheral surface of each of the bearings 360 and 362. The fixing belt 302 is thus rotatable about the center of the shaft parts 356B and 358B as the rotation center.

A gear 364 for rotational drive is attached to the outer peripheral surface at one end of the fixing belt 302 on the shaft part 358 side. The gear 364 is driven by a motor (not illustrated).

Also, support members 366 and 368 having a substantially L-shaped cross section are each joined at one end to either end of the temperature-sensitive magnetic member 314. Flat plate parts 366A and 368A are formed on the other end side of the support members 366 and 368, respectively. The support members 366 and 368 are made of a material with low heat conductivity so that the heat of the temperature-sensitive magnetic member 314 is not directly transmitted to the support members 366 and 368 as it is.

The flat plate part 366A is inserted through the through-hole 356C and the through-hole 352A, and projects more outwards than the side plate 352. Likewise, the flat plate part 368A is inserted through the through-hole 358C and the through-hole 354A, and projects more outwards than the side plate 354.

A base 370 is provided below the flat plate part 366A. The base 370 has a large width with a recess 370A formed on the top face. The base 370 is secured to the outer wall of the side plate 352. The recess 370A is positioned opposite an end of the flat plate part 366A of the support member 366.

Likewise, a base 372 is provided below the flat plate part 368A. The base 372 has a large width with a recess 372A formed on the top face. The base 372 is secured to the outer wall of the side plate 354. The recess 372A is positioned opposite an end of the flat plate part 368A of the support member 368.

One end of a coil spring 374 is secured to the recess 370A, and the other end of the coil spring 374 is secured to the underside of the flat plate part 366A. Likewise, one end of a coil spring 376 is secured to the recess 372A, and the other end of the coil spring 376 is secured to the underside of the flat plate part 368A. Thus, the temperature-sensitive magnetic member 314 is supported in place so as to be movable up and down.

As illustrated in FIG. 6, the temperature-sensitive magnetic member 314 comes into contact with the inner peripheral surface of the fixing belt 302 when the coil springs 374 and 376 are in a fully extended state (position). Thus, the fixing belt 302 is prevented from deforming outwards by the temperature-sensitive magnetic member 314.

An electric cylinder 378 is provided at a position above the flat plate part 366A and opposite the coil spring 374. The electric cylinder 378 has an actuator 380 that is projected and retracted from one side of the electric cylinder 378. The electric cylinder 378 is secured to the outer wall of the side plate 352 with the actuator 380 facing downwards.

Likewise, an electric cylinder 382 is provided at a position above the flat plate part 368A and opposite the coil spring 376. The electric cylinder 382 has an actuator 384 that is projected and retracted from one side of the electric cylinder 382. The electric cylinder 382 is secured to the outer wall of the side plate 354 with the actuator 384 facing downwards.

When in its short, retracted state, the end face of the actuator 380 slightly contacts the top face of the flat plate part 366A. Likewise, when in its short, retracted state, the end face of the actuator 384 slightly contacts the top face of the flat plate part 368A. The electric cylinders 378 and 382 are both configured to extend and contract the actuators 380 and 384, respectively, by a solenoid drive, a motor drive, or the like. It is also possible to employ an air cylinder or hydraulic cylinder that extends and contracts each of the actuators 380 and 384 by opening and closing a solenoid valve by electric control.

Figure 7A:
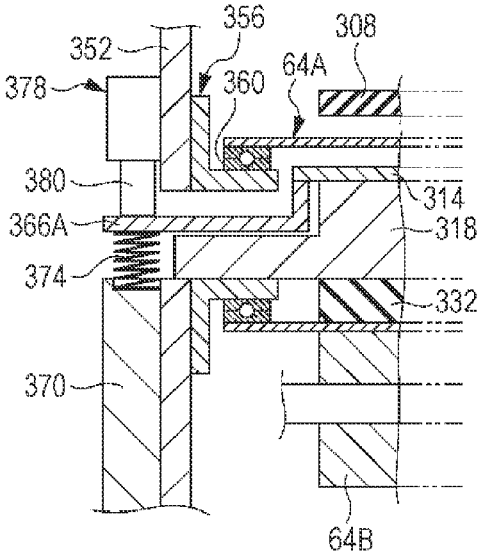

In the exemplary embodiment, when the fixing mode is the "fast heating mode", as illustrated in FIG. 7A, the MCU of the image forming section 240 controls operation of the electric cylinders 378 and 382 so as to extend the actuators 380 and 384 and contract the coil springs 374 and 376, respectively. Accordingly, as illustrated in FIG. 7B, the temperature-sensitive magnetic member 314 and the fixing belt 302 are held in a separated state.

Figure 7C:
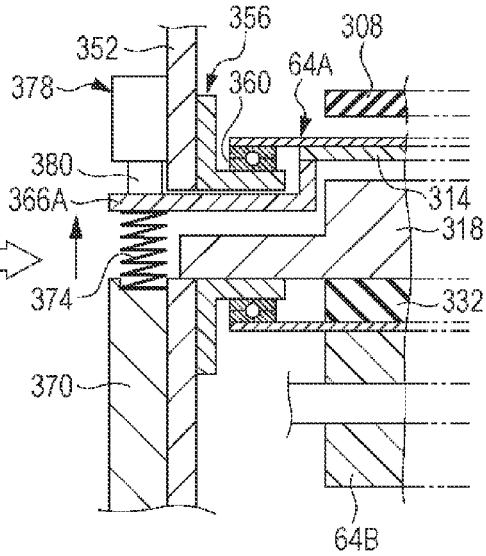
Figure 7B:
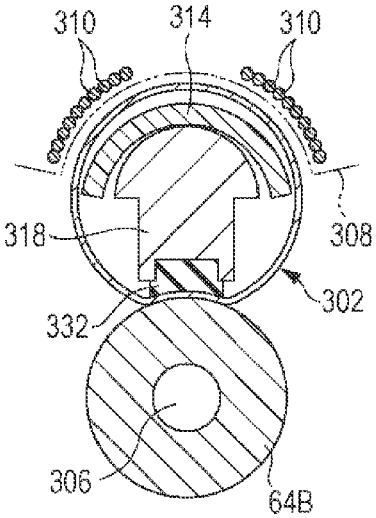
Figure 7D:
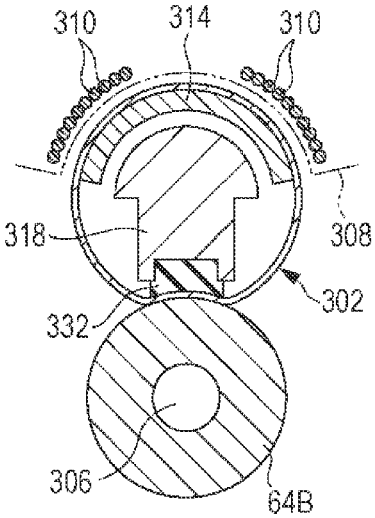

When the fixing mode is the "heat accumulation mode", as illustrated in FIG. 7C, the MCU of the image forming section 240 controls operation of the electric cylinders 378 and 382 so as to contract the actuators 380 and 384 and extend the coils 374 and 376, respectively. Accordingly, as illustrated in FIG. 7D, the temperature-sensitive magnetic member 314 and the fixing belt 302 are held in a contact state.

(Basic Specifications of Fixing Device 64)

The fixing device according to the exemplary embodiment includes the "fast heating mode" and the "heat accumulation mode" as the mode in which to execute a fixing process (fixing mode). Basically, these modes are selectively switched in accordance with the number of sheets to be processed (hereinafter also referred to as "the number of processing sheets") in an image forming process.

Table 1 is a cross comparison table between the "fast heating mode" and the "heat accumulation mode". As is apparent from Table 1, a comparison based on total processing time indicates that the "fast heating mode" is suited for small-volume processing in the range of about 1 to several sheets (hereinafter, referred to as "N sheets"), whereas the "heat accumulation mode" is suited for large-volume processing for a number of sheets exceeding N sheets. The above-mentioned number of processing sheets N that serves as the borderline to decide which mode to select obviously depends on the specifications of the image processing apparatus 10.

TABLE 1

| Fixing mode name | Relationship between fixing belt and heat accumulating member | Warm-up time | Throughput | Sur-plus power |
|---|---|---|---|---|
| Fast heating | Separated (noncontact) | Fast (3-6 sec) | Slow (20-35 ppm) | No |
| Heat accumulation | Contact | Slow (13-18 sec) | Fast (40-50 ppm) | Yes |

The terms "Fast" and "Slow" in Table 1 represent relative relationship between the two modes, and the numerical values in parentheses are an example.

(Fixing Mode Switching Control)

In a case where the number of sheets to be processed in one job of image processing is known, it is conceivable to select the fastest fixing mode for processing all of the number of processing sheets. For example, processing of the first sheet ("Warm-up time" in Table 1) may be performed fastest (fast heating mode), and then the fixing mode of the fixing device 64 may be selected and switched as necessary on the basis of whether the number of processing sheets is equal to or larger than N sheets that serves as the borderline.

That is, if the final number of processing sheets is known, as the fixing mode, it is possible to select the fast heating mode or the heat accumulation mode depending on whether or not the following operation expression holds:

$$W1+F1+P1\times N<W2+F2+P2\times N \quad (1)$$

where

N is the number of processing sheets in image processing,

F1 is the time until the first sheet of recording paper is ejected to a tray after a copy start button in the fast heating mode is operated (First Copy Output Time (FCOT)), F2 is the time until the first sheet of recording paper is ejected to a tray after a copy start button in the heat accumulation mode is operated (First Copy Output Time (FCOT)), P1 is the image processing time per sheet of recording paper in the fast heating mode, P2 is the image processing time per sheet of recording paper in the heat accumulation mode, W1 is the warm-up time for the fast heating mode, and W2 is the warm-up time for the heat accumulation mode.

While the inequality sign is "<" in the operation expression (1) mentioned above, the inequality sign may be "≤".

FCOT is sometimes referred to as First Print Output Time (FPOT).

Basically, the fast heating mode is selected in a case where the above-mentioned operation expression (1) holds, and the heat accumulation mode is selected in a case where the operation expression (1) does not hold.

Figure 8:
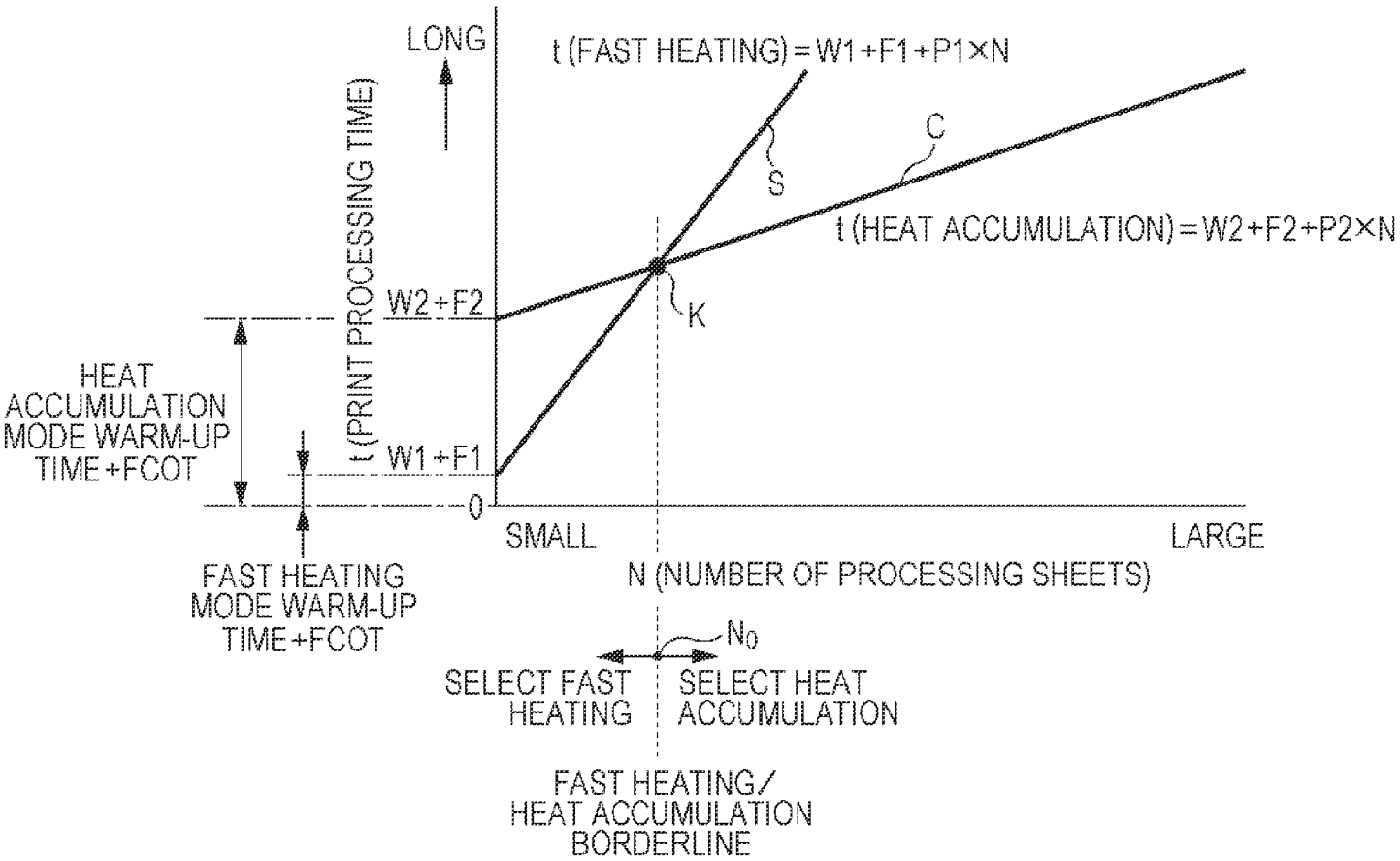
FIG. 8 is a characteristic diagram illustrating the number of processing sheets versus processing time characteristic curves for a fast heating mode and a heat accumulation mode, respectively, according to the exemplary embodiment.

FIG. 8 is a characteristic diagram illustrating correlation between the fast heating mode and the heat accumulation mode, with the number of processing sheets taken along the horizontal axis and time taken along the vertical axis.

As illustrated in FIG. 8, a fast heating mode characteristic curve S maintains a substantially directly proportional characteristic with a gradient that depends on P1, after elapse of the warm-up time (W1+F1) following an instruction for image processing. The expression "substantially directly proportional" means that theoretically, the relationship is directly proportional although the straight line of the curve may sometimes be distorted by error factors such as individual apparatus differences, temperature changes, and transport accuracy.

As illustrated in FIG. 8, a heat accumulation mode characteristic curve C maintains a substantially directly proportional characteristic with a gradient that depends on P2, after elapse of the warm-up time (W2+F2) following an instruction for image processing. The expression "substantially directly proportional" means that theoretically, the relationship is directly proportional although the straight line of the curve may sometimes be distorted by error factors such as individual apparatus differences, temperature changes, and transport accuracy.

Since the number of processing sheets is taken along the horizontal axis and time is taken along the vertical axis in FIG. 8, it follows that the greater the relative gradient, the longer the time necessary to execute processing. Accordingly, the gradient of the fast heating mode characteristic curve S is greater than that of the heat accumulation mode characteristic curve C.

Since the respective gradients (P1 and P2) of the two curves differ, the two curves (the fast heating mode characteristic curve S and the heat accumulation mode characteristic curve C) intersect at some point. This intersection (point K in FIG. 8) serves as the borderline (the value $N_0$ of the number of processing sheets) to decide whether to set the fixing mode to the fast heating mode or the heat accumulation mode. This borderline is, for example, about 10 sheets when conversion is done using the numerical values in Table 1.

In other words, in a case where the number of processing sheets is known, on the basis of the operation expression (1) mentioned above, the fast heating mode is selected up to 10 sheets, and the heat accumulation mode is selected for 11 or more sheets.

In a case where the number of processing sheets is not known, the discrimination based on the operation expression (1) is not possible.

Accordingly, in the exemplary embodiment, by assessing the advantages and disadvantages of the fast heating mode and heat accumulation mode as illustrated in Table 1 mentioned above comprehensively, a control to switch the fixing mode for a job for which the number of processing sheets is unknown is established.

(With Regard to Type of Job)

Copying and remote print are typical examples of jobs processed by using the image forming section 240 in the image processing apparatus 10. As another type of job, for example, there is "print anywhere" as on-demand processing.

"Copying" is a process that reads a document image (read document G) by the image reading section 238 while forming the read image on the recording paper P by the image forming section.

If a copying process is executed after waiting until reading of the read document G is complete, the total processing volume (the number of processing sheets N) is found out from the number of sets specified, or the like. In this case, the larger the volume of the read document G, the longer FCOT tends to become.

Accordingly, usually, an image forming process is executed in parallel with an image reading process. At the time when sleep is cancelled, there is no information about copying. Accordingly, at the time of sleep cancellation, it is unknown whether the fast heating mode is appropriate or the heat accumulation mode is appropriate as the fixing mode.

In "remote print", image information and print type (such as the number of pages, the number of sets, and N-up) are accepted upon instruction from a printer driver installed in the PC 21 or the like, and thus the number of processing sheets N can be recognized from this print type. Therefore, whether the fast heating mode is appropriate or the heat accumulation mode is appropriate as the fixing mode is found out before the image forming process begins.

"Print anywhere" is a feature in which, for example, the user outputs image information stored in the PC 21 or a server, by using the image processing apparatus 10 located near the place where execution of printing is instructed. By cancelling sleep and operating the UI touch panel 216, the user fetches image information from a stored location, and starts image formation after selecting/deselecting a print document, and changing print settings.

Accordingly, at the time of sleep cancellation, the user does not know whether the fast heating mode is appropriate or the heat accumulation mode is appropriate as the fixing mode.

Among the typical jobs (copying, remote print, and print anywhere) mentioned above, in those kinds of jobs (copying and print anywhere) for which it is unknown whether the fast heating mode is appropriate or the heat accumulation mode is appropriate as the fixing mode, the image forming process is started in the fast heating mode at least as initial processing.

On the basis of the number N of the total number of processing sheets found out later, the optimum fixing mode (e.g. one that minimizes the time required for finishing processing), and continued processing is executed. That is, as necessary, the continued processing takes over the fixing mode (fast heating mode) of the initial processing in some cases, or switches the fixing mode (fast heating mode) of the initial processing to the heat accumulation mode in some cases.

Hereinafter, operation of the exemplary embodiment will be described.

Figure 9:
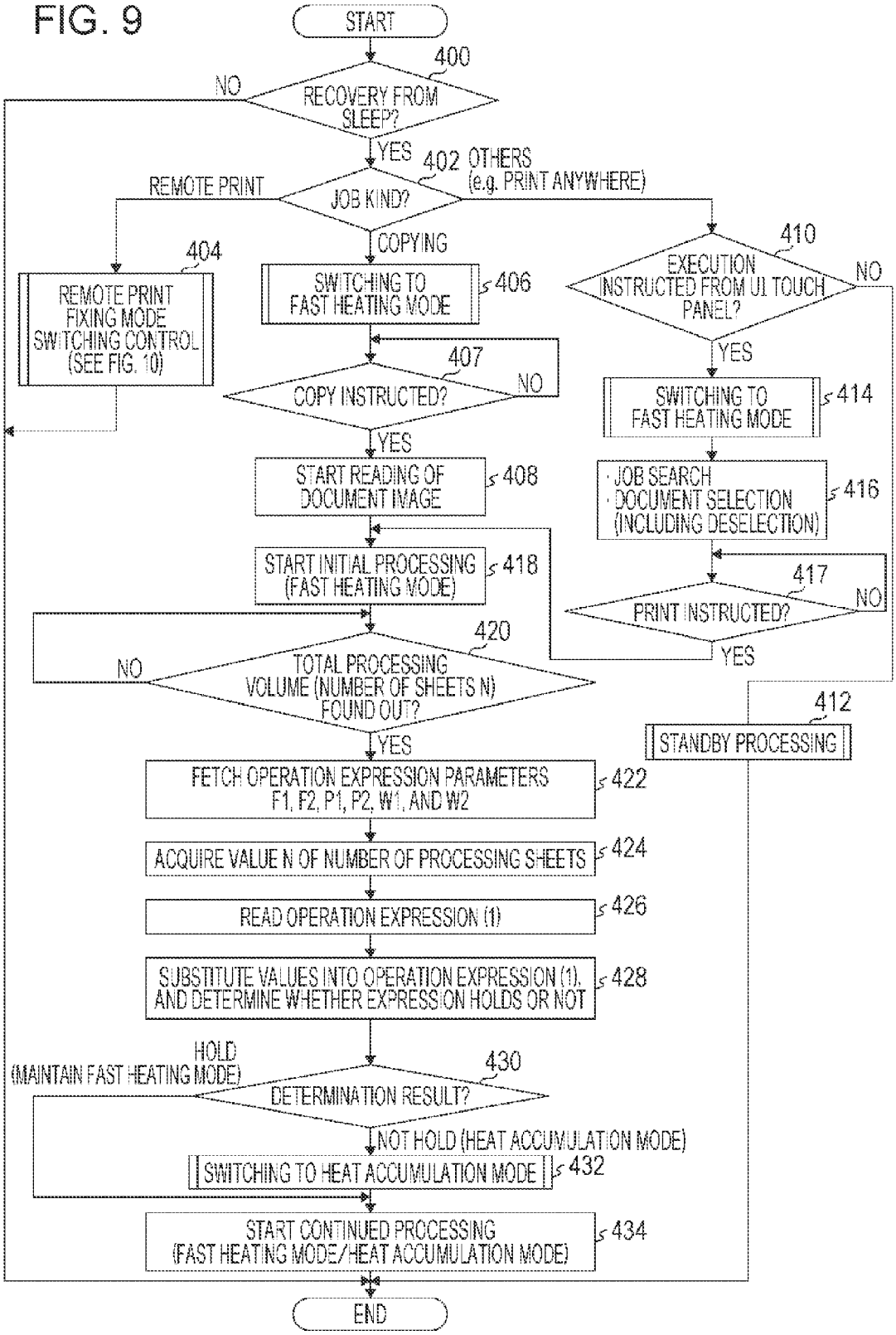
FIG. 9 is a flowchart illustrating a control routine for switching a fixing mode of the fixing device in the control of image processing in the image processing apparatus according to the exemplary embodiment.

FIG. 9 is a control flowchart focusing on steps executed before determining the fixing mode of the fixing device 64 during so-called sleep in which power is not being supplied to the fixing device 64.

In step 400, it is determined whether or not the fixing device 64 has recovered from sleep. If the determination is No, the sleep state is maintained, and this routine ends. Recovery from sleep includes, for example, recovery based on operation of a power save control button, operation of the UI touch panel 216 or a service button set for a hard key in the vicinity of the UI touch panel 216, or sensing of a user by a human sensor in a case where such a human sensor is equipped.

If the determination is Yes in step 400, the processing transfer to step 402, and the type of job (job type) involving image formation accepted after the recovery from sleep is discriminated. In this case, in partial power save mode, a service selecting screen (the UI touch panel 216) starts up, and the image forming section 240 remains OFF. When not in partial power save mode, the fixing device 64 may be started up in the fast heating mode at this point.

While jobs not involving an image forming process are omitted in the flowchart in FIG. 9, for example, for jobs such as image reading or FAX transmission, this routine is skipped through.

In a case where it is found out in step 402 that the job type is remote print, the processing transfers to step 404, and a remote print fixing mode switching control is executed. This remote print fixing mode switching control will be described later with reference to FIG. 10.

In a case where it is determined in step 402 that the job type is copying, the processing transfers to step 406, in which switching to the fast heating mode is executed.

In a case where the fixing mode is the "fast heating mode", as illustrated in FIG. 7A, the MCU of the image forming section 240 controls the operation of the electric cylinders 378 and 382 so as to extend the actuators 380 and 384 and contract the coil springs 374 and 376, respectively. Accordingly, as illustrated in FIG. 7B, the temperature-sensitive magnetic member 314 and the fixing belt 302 are held in a separated state.

In the next step 407, it is determined whether or not an instruction to start copying (operation of a start button) has been made, and the processing transfers to step 408 if the determination is Yes. In step 408, reading of a document image is started in the image reading section 238. Then, the processing transfers to step 418 and initial processing is started.

In a case where it is determined in step 402 mentioned above that the job type is other than remote print or copying, for example, print anywhere (on-demand mode), the processing transfer to step 410.

In step 410, it is determined whether or not an instruction to execute an image forming process has been received under the print anywhere mode as a result of the user operating the UI touch panel 216.

If the determination is No in step 410, the processing transfers to step 412, and after a standby process, this routine ends. A standby process refers to, for example, a state in which image information with a large information volume such as graphic images is being acquired.

If it is determined in step 410 mentioned above that an instruction to execute an image forming process has been received under the print anywhere mode as a result of the user operating the UI touch panel 216 (determination of Yes), the processing transfers from step 410 to step 414, in which switching to the fast heating mode is executed. Then, the processing transfers to step 416. In step 416, the corresponding job is searched for, or a document is selected, and the processing transfers to step 417.

In step 417, it is determined whether or not an instruction to start printing (operation of a start button) has been made. If the determination is Yes, the processing transfers to step 418, and initial processing is started. The job search includes access to a specified PC, server, or the like.

In the initial processing in step 418, the fixing mode is the fast heating mode. Accordingly, as illustrated in Table 1 mentioned above, the warm-up time is 3 to 6 seconds and thus start-up is faster than in the heat accumulation mode. Therefore, it is possible to execute the image forming process while reading a document image.

In the next step 420, it is determined whether or not the total processing volume (the number of sheets N) has been found out on the basis of the number of sheets, the number of sets of copies, and the like of the read document image. If the determination is Yes, the processing transfers to step 422.

In step 422, the operation expression parameters F1, F2, P1, P2, W1, and W2 are fetched. These parameters include fixed numerical values (constants) and values that vary with the environment (variables). These parameters may be fetched every time an instruction for image processing is made.

For example, the parameter W is the warm-up time that varies with the initial temperature of the temperature-sensitive magnetic member 314 or the like. Accordingly, the timing of fetching this parameter may sometimes vary with the presence/absence of residual heat from the previous image processing, or with variation of the initial temperature due to the environmental temperature.

The parameters F1 and F2 each represent FCOT that is determined by the first copy characteristics of the image forming section 240. Since an allowable range of temperature exists for the fixing temperature, the FCOT may sometimes differ between the upper limit and lower limit of the temperature range.

The parameters P1 and P2 are each dependent on the transport capability of the apparatus and therefore a fixed value theoretically. However, this value may sometimes vary if there is a change in stand-by time or the like due to a factor such as a change in the control program of the transport system.

In the next step 424, the value N of the number of processing sheets is acquired. Then, the processing transfers to step 426, in which the operation expression (1) is read, and the processing then transfers to step 428.

$$W1+F1+P1\times N\leq W2+F2+P2\times N \quad (1)$$

In step 428, the parameters fetched in step 422 mentioned above, and the value N of the number of processing sheets acquired in step 424 are substituted into the operation expression (1), and it is determined whether or not the operation expression (1) holds. The processing then proceeds to step 430.

In step 430, the results of determination are discriminated. If it is determined in step 430 that the operation expression (1) "holds", the fast heating mode being currently set is maintained, and the processing transfers to step 434. If it is determined in step 430 that the operation expression (1) "does not hold", the processing transfers to step 432, in which switching to the heat accumulation mode is executed, and then the processing transfers to step 434.

When switching the fixing mode to the "heat accumulation mode", as illustrated in FIG. 7C, the MCU of the image forming section 240 controls the operation of the electric cylinders 378 and 382 so as to contract the actuators 380 and 384 and extend the coil springs 374 and 376, respectively. Accordingly, as illustrated in FIG. 7D, the temperature-sensitive magnetic member 314 and the fixing belt 302 are held in a contact state.

In the next step 434, image processing is executed, and this routine ends.

Figure 11:
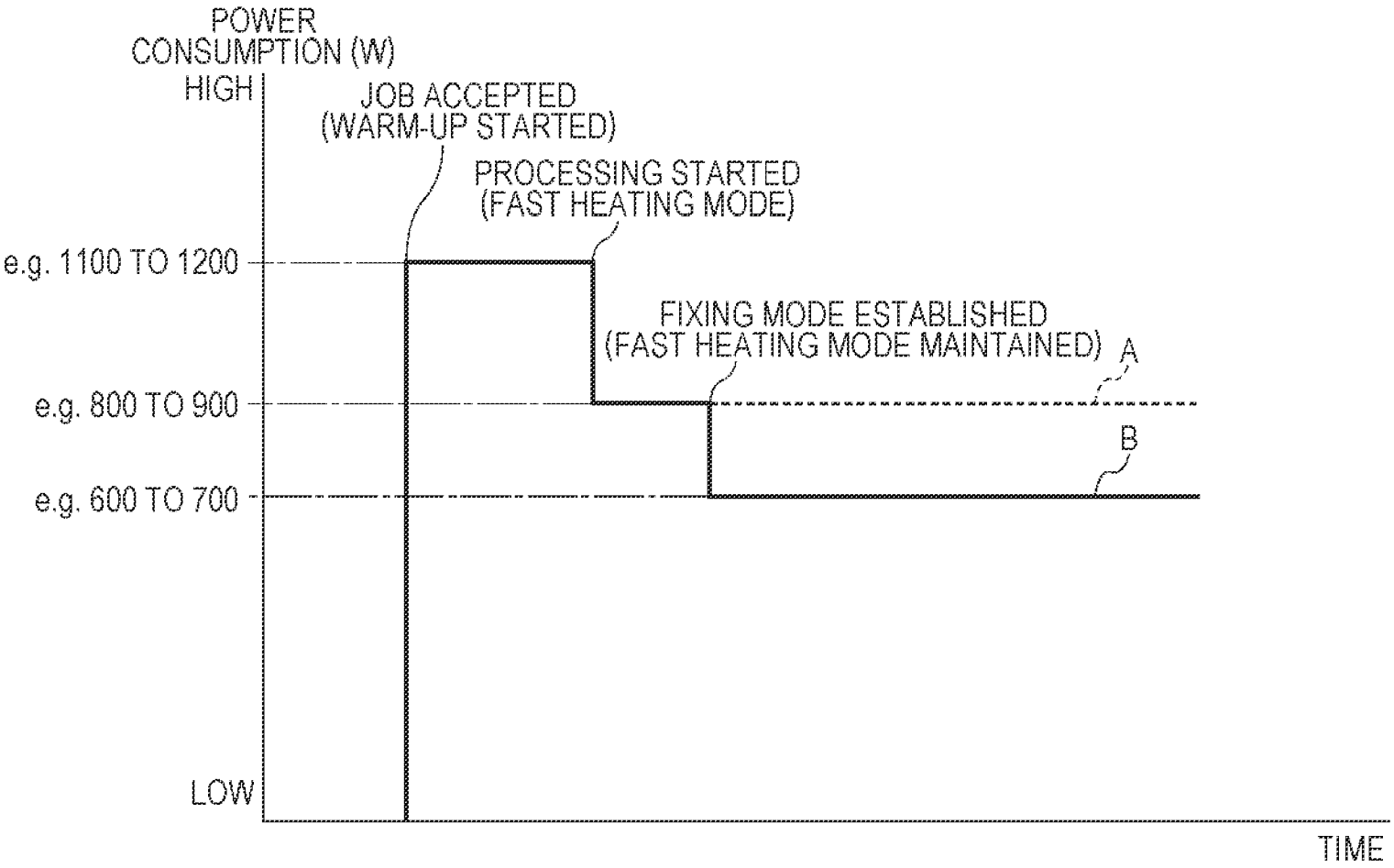
FIG. 11 is a characteristic diagram illustrating a difference in the transition of power consumption based on the fixing mode.

If it is determined in step 430 mentioned above that the operation expression (1) "holds", that is, the fast heating mode is to be maintained, continued processing is started as it is. In this case, because it is predicted that there is a possibility of the fixing mode being switched to the heat accumulation mode, as indicated by a dotted line (see an arrow A) in FIG. 11, for example, after warm-up at full power (approximately 1100 W to 1200 W), the temperature-sensitive magnetic member 314 that is a heat accumulating member is heated at the power (e.g. 800 W to 900 W) set at the start of processing.

In this heating, to avoid shortage of heat quantity in the heat accumulation mode, excess power is consumed in order to maintain more than necessary heating capacity. Accordingly, once it is established that the processing is to be continued in the fast heating mode, as indicated by a solid line (see an arrow B) in FIG. 11, power consumption may be set to a level lower than full power (approximately 600 W to 700 W). Since the proportion of heat that is taken away by the recording paper is smaller in the fast heating mode than in the heat accumulation mode, even heating at the above-mentioned low power does not lead to shortage of thermal energy.

Figure 10:
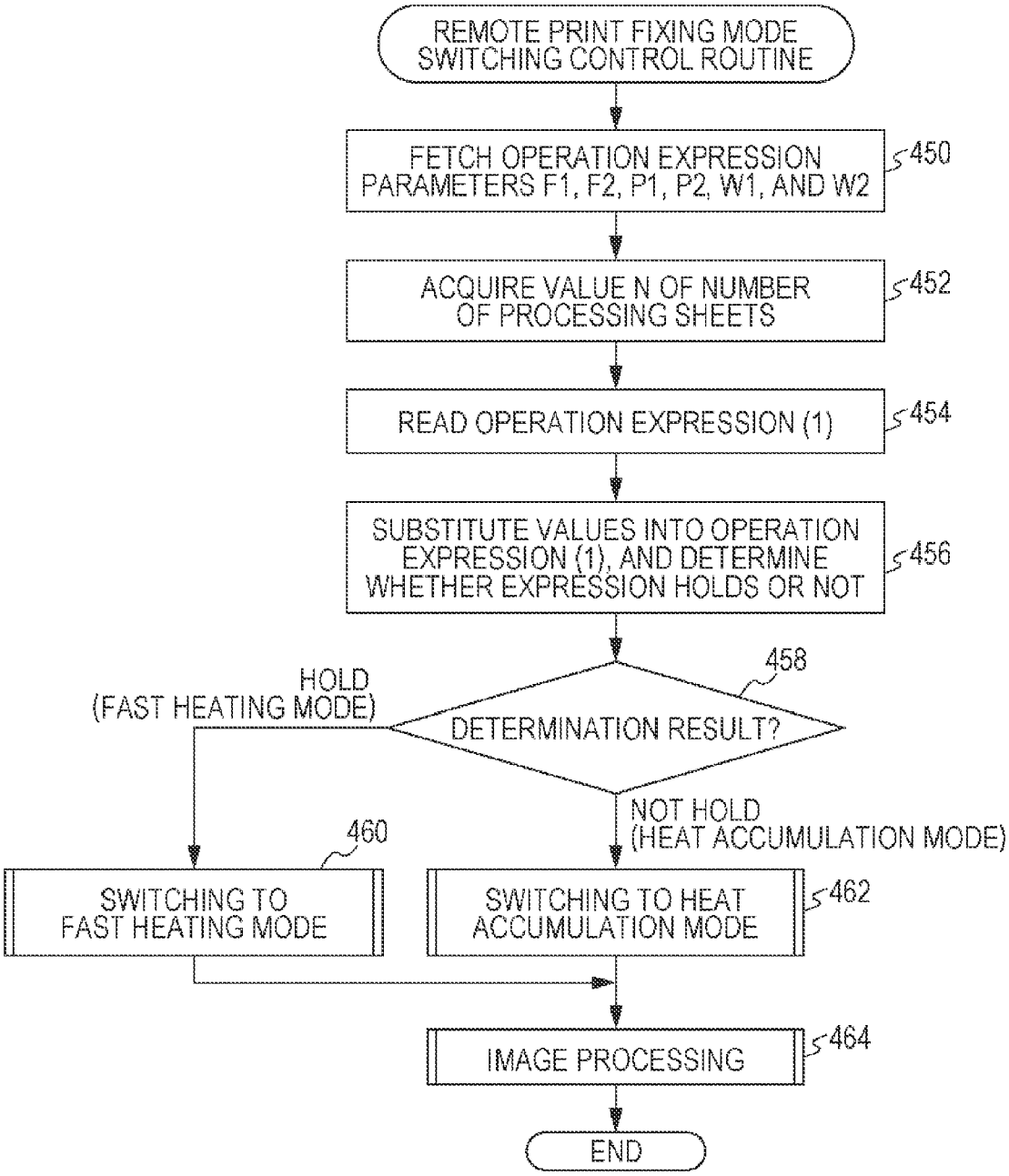
FIG. 10 is a flowchart illustrating a remote print fixing mode switching control routine in step S404 in FIG. 9.

FIG. 10 is a flowchart illustrating a remote print fixing mode switching control routine in step S404 in FIG. 9.

In step 450, the operation expression parameters F1, F2, P1, P2, W1, and W2 are fetched.

In the next step 452, the value N of the number of processing sheets is acquired. Then, the processing transfers to step 454, in which the operation expression (1) is read, and the processing then transfers to step 456.

In step 456, the parameters fetched in step 450 mentioned above, and the value N of the number of processing sheets acquired in step 452 are substituted into the operation expression (1), and it is determined whether or not the operation expression (1) holds. The processing then proceeds to step 458.

In step 458, the results of determination are discriminated. If it is determined in step 458 that the operation expression (1) "holds", the processing transfer to step 460, in which switching to the fast heating mode is executed, and the processing then transfers to step 464. If it is determined in step 458 that the operation expression (1) "does not hold", the processing transfers to step 462, in which switching to the heat accumulation mode is executed, and then the processing transfers to step 464.

In the next step 464, image processing is executed, and this routine ends.

The switching of the fixing mode in each of steps 460 and 462 is executed as described below.

According to the exemplary embodiment, in a case where a job is accepted in a state in which the fixing device 64 is sleeping and not being supplied with power, when processing one unit of processing (which is, for example, one job, or multiple jobs during on-demand processing, and has a period during which an image forming process is performed continuously), the total processing volume (the total number of processing sheets N) is unknown, and hence the optimum fixing mode is unknown. Accordingly, as initial processing, processing is started under the fast heating mode, and when the optimum fixing mode is found out on the basis of the total number of processing sheets N or the like after the start of processing, the fixing mode is switched to the heat accumulation mode as necessary and continued processing is performed. In some cases, the fixing mode is not switched, and continued processing is performed while maintaining the fast heating mode. By setting the fixing mode to the fast heating mode in the initial processing, it is possible to minimize at least the sum of the recovery time from the sleep mode and FCOT.

By setting the fixing mode again in the continued processing, the processing finish time can be optimized in accordance with the details of a copy job (e.g. the number of documents, the number of sheets to copy, and the 2up setting) that are not known at the time of sleep cancellation.

Moreover, by setting the fixing mode again in the continued processing, the processing finish time can be optimized in accordance with the details of an on-demand job (e.g. selection/deselection of a print document, and changing of whether to print in color or black and white) that are not known at the time of sleep cancellation.

The image processing apparatus according to the exemplary embodiment includes a power supply controller, a mode switching section, and a processing controller. The power supply controller causes a fixing device to transition to a power supply state or a power shut-off state in accordance with the processing state of an image forming section including the fixing device. The fixing device fixes an image to recording paper by applying heat treatment. The mode switching section selectively switches between a first mode that relatively focuses on rapid raising of temperature and a second mode that relatively focuses on productivity, as a fixing mode in which to heat a fixing member in advance by using electric power. The fixing member is provided to the fixing device and comes into contact with the recording paper. In the case of executing an image forming process upon an instruction to execute a job indicating a period during which the image forming process is performed continuously, irrespective of whether the instruction is a single execution instruction or multiple execution instruction, as initial processing when a fixing device recovers to the power supply state from the power shut-off state, the processing controller executes the image forming process in the first mode, and as continued processing after the initial processing, the processing controller executes the image forming process after selecting whether to maintain the first mode or switch to the second mode on the basis of the total processing volume of the job acquired after the instruction to execute the job is made.

Modification 1

In the exemplary embodiment, on the basis of the number of processing sheets N, other operation expression parameters are used to select the optimum fixing mode on the basis of the operation expression (1). However, the fixing mode may be selected simply on the basis of the number of processing sheets N.

Modification 2

In the exemplary embodiment, a switching control (including cases where the current fixing mode is maintained) is executed when the optimum fixing mode is found out from the operation expression (1). However, for example, in a case where multiple sets of a job are set, the switching control may take place between sets of the job.

For example, in the case of an image forming process for 6 pages and 20 sets, when it is found out that the heat accumulation mode is the optimum fixing mode at the fourth page of the first set, processing may be performed in the fast heating mode until the sixth page and then the fixing mode may be switched to the heat accumulation mode. Accordingly, for example, it is possible for the user to check all pages while on standby).

Modification 3

In the exemplary embodiment, a switching control (including cases where the current fixing mode is maintained) is executed when the optimum fixing mode is found out from the operation expression (1). However, the following configuration may be also employed. That is, while an image forming process is executed in the fast heating mode, a change (increase) in the number of processing sheets is monitored, and once the operation expression (1) ceases to hold, the fixing mode is changed from the fast heating mode to the heat accumulation mode in accordance with the relationship between the time required until the end of processing when image processing is continuously executed in the fast heating mode, and the time required until the end of processing when image processing is executed by switching the fixing mode again.

The "relationship between the time required until the end of processing when image processing is continuously executed in the fast heating mode, and the time required until the end of processing when image processing is executed by switching the fixing mode again" means that because the optimum fixing mode affects not only the remaining number of processing sheets N but also the mechanical operation time required for changing the fixing mode during image processing, as well as the speed switching time (acceleration, deceleration, temporary stop, or the like) of the transport system for the recording paper P, whether or not to change the fixing mode is to be determined by taking various factors into consideration.

While in this specification the exemplary embodiment is directed to the case where a program is provided by a communication section, it is also possible to provide the program by storing the program in a memory medium such as a CD-ROM.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image processing apparatus comprising:

an image forming section including a fixing device;

a power supply controller configured to control the fixing device to a power supply state in which power is supplied or a power shut-off state;

a switching section configured to switch a fixing mode to one of a first mode that focuses on temperature, and a second mode that focuses on productivity; and a processing controller configured to control an image forming process, by selecting the first mode as initial processing when the fixing device recovers from the power shut-off state to the power supply state upon an instruction to execute a job, and selecting, as continued processing after the initial processing, the first mode or the second mode on a basis of a total processing volume of the job acquired after the instruction to execute the job is made, wherein in the continued processing, in a case where the fixing mode is to be maintained in the first mode, after a determination to maintain the first mode is made, an amount of consumption of the power is switched to be lower than a predetermined amount of consumption of the power in normal operation.

2. An image processing apparatus comprising:

an image forming section including a fixing device;

a power supply controller configured to control the fixing device to a power supply state in which power is supplied or a power shut-off state;

a switching section configured to switch a fixing mode to one of a first mode that focuses on temperature, and a second mode that focuses on productivity; and a processing controller configured to control an image forming process, by selecting the first mode as initial processing when the fixing device recovers from the power shut-off state to the power supply state upon an instruction to execute a job, and selecting, as continued processing after the initial processing, the first mode or the second mode on a basis of a total processing volume of the job acquired after the instruction to execute the job is made, wherein in a case where a type of the job is a remote printing process that accepts image information and an image formation instruction via a communication line, and executes the image forming process in the image forming section, the fixing mode is set to one of the first mode and the second mode in a fixed manner, and switching of the fixing mode by the processing controller is inhibited.

3. A method for controlling an image processing apparatus, the method comprising:

controlling a fixing device of an image forming section to a power supply state in which power is supplied or a power shut-off state;

switching a fixing mode to one of a first mode that focuses on temperature, and a second mode that focuses on productivity;

selecting the first mode as initial processing when the fixing device recovers from the power shut-off state to the power supply state upon an instruction to execute a job; and selecting, as continued processing after the initial processing, the first mode or the second mode on a basis of a total processing volume of the job acquired after the instruction to execute the job is made, wherein in the continued processing, in a case where the fixing mode is to be maintained in the first mode, after a determination to maintain the first mode is made, an amount of consumption of the power is switched to be lower than a predetermined amount of consumption of the power in normal operation.

* * * * *